US009070995B2

(12) United States Patent
Yagome et al.

(10) Patent No.: US 9,070,995 B2
(45) Date of Patent: Jun. 30, 2015

(54) CONNECTOR UNIT

(75) Inventors: Sachiko Yagome, Makinohara (JP); Ayumu Ishikawa, Makinohara (JP); Kazuki Zaitsu, Makinohara (JP)

(73) Assignee: Yazaki Corporation, Tokyo (JP)

( * ) Notice: Subject to any disclaimer, the term of this patent is extended or adjusted under 35 U.S.C. 154(b) by 175 days.

(21) Appl. No.: 13/885,171

(22) PCT Filed: Nov. 14, 2011

(86) PCT No.: PCT/JP2011/076172

§ 371 (c)(1),
(2), (4) Date: May 14, 2013

(87) PCT Pub. No.: WO2012/067066

PCT Pub. Date: May 24, 2012

(65) Prior Publication Data

US 2013/0237074 A1 Sep. 12, 2013

(30) Foreign Application Priority Data

Nov. 17, 2010 (JP) ..... 2010-257033

(51) Int. Cl.
*H01R 13/44* (2006.01)
*H01R 13/453* (2006.01)

(52) U.S. Cl.
CPC ..... *H01R 13/44* (2013.01); *H01R 13/4538* (2013.01)

(58) Field of Classification Search
USPC ..... 439/141, 140
IPC ..... H01R 13/4538,13/447, 13/453, 13/631, H01R 13/635
See application file for complete search history.

(56) References Cited

U.S. PATENT DOCUMENTS 5,030,119 A * 7/1991 Lowe ..... 439/141
5,376,014 A * 12/1994 Sumida ..... 439/310

(Continued)

FOREIGN PATENT DOCUMENTS

JP 61-161975 U 10/1986
JP 2564468 Y2 3/1998

(Continued)

OTHER PUBLICATIONS

Notification of Reasons for Refusal mailed Sep. 24, 2014, issued for the Japanese patent application No. 2010-257033 and English translation thereof.

(Continued)

*Primary Examiner* — Hien Vu
(74) *Attorney, Agent, or Firm* — Locke Lord LLP; James E. Armstrong, IV; Brian S. Matross

(57) ABSTRACT

A connector unit which prevents a user from contacting a first terminal fitting when fitting a first connector and a second connector together is provided. A connector unit 20 includes a first connector 1 having a first housing 4 receiving a first terminal fitting 3 and a contact-preventive housing 51 disposed between the first terminal fitting and the first housing, and a second housing to be fitted to the first housing. The contact-preventive housing includes a tension spring 6 having one end fixed at an outer circumference of the contact-preventive housing and the other end being a free-end arranged to engage to the first housing to restrict the contact-preventive housing from sliding. The second housing includes an entering portion 12 which enters between the tension spring and the first housing and pushes the tension spring to disengage the tension spring to permit the contact-preventive housing to slide.

2 Claims, 10 Drawing Sheets

(56) References Cited

U.S. PATENT DOCUMENTS 6,231,358 B1 5/2001 Kerr, Jr. et al.
6,786,747 B1 * 9/2004 Kamath ..... 439/188

FOREIGN PATENT DOCUMENTS

JP 2009-301857 A 12/2009
JP 2010-146843 A 7/2010
WO WO-00/46881 A1 8/2000

OTHER PUBLICATIONS

Supplementary European Search Report dated Jul. 4, 2014, issued for the European patent application No. 11842022.3.

International Search Report dated Feb. 14, 2012, issued for PCT/JP2011/076172.

* cited by examiner

CONNECTOR UNIT

TECHNICAL FIELD

The present invention relates to a connector unit provided with a first connector having a rod-shaped first terminal fitting, a tube-shaped first housing arranged to receive the first terminal fitting and a contact-preventive housing disposed between the first terminal fitting and the first housing, wherein the contact-preventive housing has an aperture through which the first terminal fitting is passed and is arranged to slide along a longitudinal direction of the first terminal fitting.

BACKGROUND ART

An automobile as a moving body driven by a driving force of a motor is mounted with various electronic devices such as a motor and an inverter. Conventionally, various connector units are used for interconnecting the motor and the inverter.

FIG. 12 is a perspective view of a conventional connector unit. A connector unit 110 shown in FIG. 12 is provided with a first connector 101 and a second connector 102, the first connector 101 having a plurality of rod-shaped male-type terminals 103, a male-type housing 104 to which the plurality of male-type terminals 103 is attached and a contact-preventive housing 105, and the second connector 102 having a plurality of female-type terminals 109 to be connected to the plurality of male-type terminals 103, respectively, and a female-type housing 111 made of synthetic resin. The female-type housing 111 is formed with a plurality of receiving portions 112 arranged to receive the respective female-type terminals 109 and is arranged to fit with the male-type housing 104. In FIG. 12, an arrowed Y direction indicates a longitudinal direction of the male-type terminal 103 and a sliding direction of the contact-preventive housing 105, and an arrowed X direction indicates a direction of alignment of the plurality of male-type terminals 103 and the plurality of receiving portions 112.

For the first connector 101 described above, the contact-preventive housing 105 is attached to an exposed portion of the male-type terminal 103 to prevent a user from getting shocked by contacting the male-type terminal 103 when fitting these connectors 101, 102 together.

There is provided an engagement receiving portion 131 formed at a tip end of the male-type terminal 103 on a side close to the second connector 102 and arranged to protrude from the male-type terminal 103. The contact-preventive housing 105 includes an engagement arm 151 arranged to engage to the engagement receiving portion 131 to prevent the contact-preventive housing 105 from sliding in the direction towards the male-type housing 104 (i.e. the Y direction). The engagement arm 151 includes an arm portion 152 extending along the Y direction and arranged to deform in directions away from and towards the engagement receiving portion 131, and an engagement portion 153 formed on the engagement receiving portion 131 on a side close to the second connector 101 and arranged to project from a tip end of the arm portion 152 in the X direction so as to engage to the engagement receiving portion 131.

The receiving portion 112 of the female-type housing 111 is provided with a disengagement projection 113 arranged to project towards the male-type housing 104 and arranged to disengage the engagement arm 151 from the engagement receiving portion 131. While this disengagement projection 113 is abutted on the engagement arm 151, when the female-type housing 111 (the second connector 102) is moved towards the male-type housing 104 (the first connector 101), the disengagement projection 113 deforms the arm portion 152 of the engagement arm 151 in a direction away from the engagement receiving portion 131, thereby disengaging the engagement portion 153 from the engagement receiving portion 131. After the engagement arm 151 is disengaged from the engagement receiving portion 131, the contact-preventive housing 105 is allowed to slide with respect the male-type terminal 103. Thus, the contact-preventive housing 105 slides towards the male-type housing 104 to allow the male-type terminal 103 entering into the female-type terminal 109, thereby fitting the first connector 101 and the second connector 102 together (for example, refer to Patent Document 1).

CITATION LIST

Patent Document

[Patent Document 1]
Japanese Patent Application Publication No. 2009-301857

SUMMARY OF INVENTION

Technical Problem

However, the conventional connector unit 110 described above has a following problem. That is, for the conventional connector unit 110, for example when a user has accidentally pushed the contact-preventive housing 105 towards the male-type housing 104, a force applied to the engagement arm 151 in the Y direction may cause a breakage of the engage arm 151 (the engagement portion 153). The breakage of the engagement arm 151 causes the contact-preventive housing 105 to slide towards the male-type housing 104, causing the male-type terminal 103 to be exposed, thereby creating a risk of a user contacting the male-type terminal 103.

Furthermore, because the engagement arm 151 is disengaged from the engagement receiving portion 131 by making the arm portion 152 deform in the direction away from the engagement receiving portion 131, there is required a large force for the disengagement projection 113 to make the arm portion 152 deformed in the direction away from the engagement receiving portion 131, imposing physical burden on the user. Moreover, the disengagement projection 113 of the female-type housing 111 (i.e. the second connector 102) is pushed against the contact-preventive housing 105 to make the arm portion 152 deform, thus there is a risk of breakage of the disengagement projection 113. Moreover, in order to make the arm portion 152 deformed in the direction away from the engagement receiving portion 131, it is necessary to utilize resin deformation of the arm portion 152; however, creep phenomenon occurs after the application of heat which may reduce the engagement force.

In view of the above-described problems, an object of the present invention is to provide a connector unit which can prevent a user from contacting the first terminal fitting when fitting the first connector and the second connector together.

Solution to Problem

The present invention provides, in a first aspect, a connector unit including: a first connector having a rod-shaped first terminal fitting, a tube-shaped first housing arranged to receive the first terminal fitting and a contact-preventive housing disposed between the first terminal fitting and the first housing, the contact-preventive housing including an aperture through which the first terminal fitting is passed and being arranged to slide along a longitudinal direction of the first terminal fitting; and a second connector having a second terminal fitting to be connected to the first terminal fitting and a second housing arranged to receive the second terminal fitting and arranged to fit with the first housing. The contact-preventive housing includes a tension spring having one end fixed at an outer circumference of the contact-preventive housing and the other end arranged as a free end, the other end extending away from the second connector along the longitudinal direction and being arranged to engage to the first housing to restrict the contact-preventive housing from sliding. The tension spring includes a tapered portion slanted away from the contact prevention housing in a direction from the one end to the other end of the tension spring. The second housing includes an entering portion arranged to enter between the tension spring and the first housing when moved towards the first housing and pushes the tapered portion towards the contact-preventive housing, thereby making the other end of the tension spring disengaged from the first housing to permit the contact-preventive housing to slide.

According to a second aspect of the present invention, the tension spring according to the first aspect of the present invention is made of metal.

The present invention provides, in a third aspect, the connector unit according to the first or the second aspect further including: a return spring attached to an outer circumference of the contact-preventive housing; and a slanted face provided at an inner circumference of the first housing, the slanted face being slanted towards the first terminal fitting in a direction away from the second connector. The return spring includes an abutting portion arranged to project towards the slanted face so as to abut on the slanted face.

Advantageous Effects of Invention

According to the first aspect of the present invention, when a user has pushed the contact-preventive housing with a finger while the other end of the tension spring is engaged to the first housing, i.e. while the contact-preventive housing is positioned at the contact-prevention position, the tension spring restricts the contact-preventive housing from sliding. Consequently, the first terminal fitting can be avoided from being exposed. Thus, the connector unit which can prevent the contact with the first terminal fitting can be provided.

Furthermore, when a user has pushed the contact-preventive housing with a finger, the tension spring deforms and pushes back a force applied to the contact-preventive housing. Consequently, there is no risk of the breakage of the engagement arm as there was in the conventional case, and also, the contact-preventive housing can be positioned at the contact-prevention position in a reliable manner when fitting the first connector and the second connector together.

Moreover, the entering portion is arranged to enter between the tension spring and the first housing and push the tapered portion towards the contact-preventive housing to disengage the tension spring from the first housing to permit the contact-preventive housing to slide. Thus, the other end of the tension spring engaged to the first housing is displaced towards inside of the first housing, thereby disengaging the tension spring from the first housing. Thus, the tension spring can be disengaged from the first housing with a smaller force (i.e. more easily) compared to the conventional structure.

According to the second aspect of the present invention, the tension spring is made of metal. Thus, when the tension spring is exposed to heat from a heated first terminal fitting which is heated due to a current flow in the first terminal fitting, there is less deterioration caused by warpage or twist compared to the conventional engagement arm made of resin, thereby allowing a long-term usage.

According to the third aspect of the present invention, after the other end of the tension spring is disengaged from the first housing, when the second connector is removed (separated) from the first connector while the contact-preventive housing being slidable, the reaction force of the return spring pushes back the contact-preventive housing towards the second housing (the second connector) and the contact-preventive hosing is positioned at the contact-prevention position. Consequently, the first terminal fitting is prevented from being exposed, thereby preventing the contact with the first terminal fitting in even more reliable manner.

Furthermore, even without the use of a coil spring and such as the return spring, the contact-preventive housing can be pushed towards the second housing (the second connector) so that the contact-preventive housing is positioned at the contact-prevention position, thereby achieving a simple structure and reducing the manufacturing cost.

DESCRIPTION OF EMBODIMENTS

Figure 1:
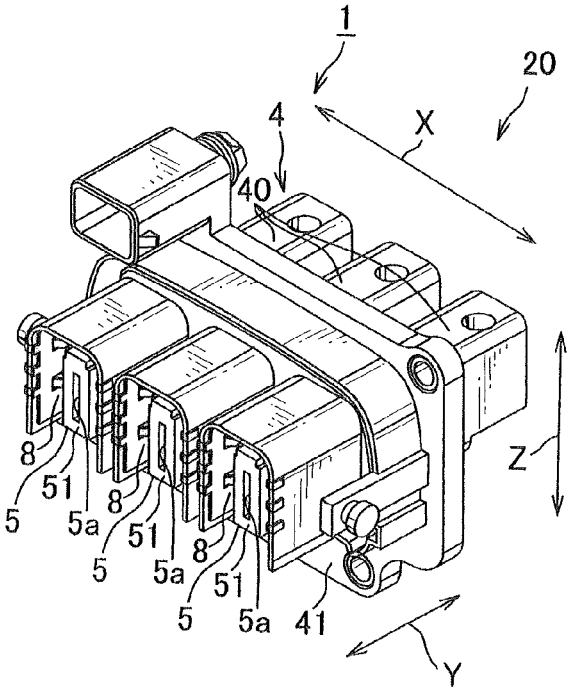
FIG. 1 is a perspective view of a first connector constituting a connector unit according to one embodiment of the present invention.
Figure 2:
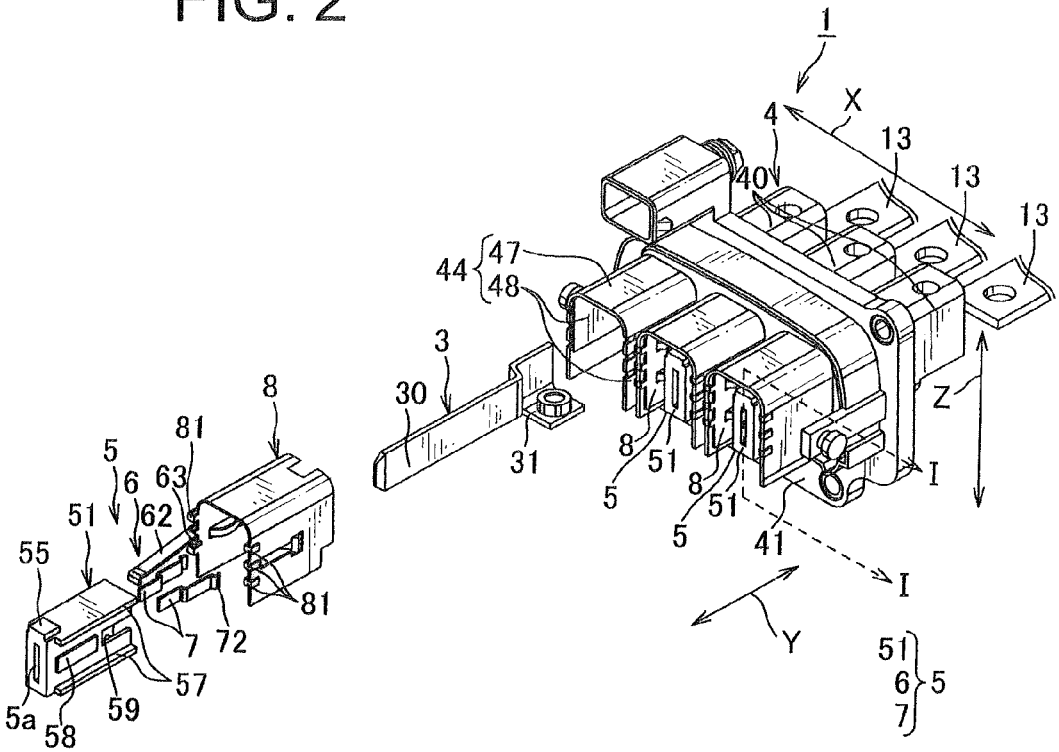
FIG. 2 is an exploded perspective view of the first connector constituting the connector unit shown in FIG. 1.

In the following, a connector unit according to one embodiment of the present invention is explained in reference with FIGS. 1 through 11. A connector unit 20 shown in FIG. 1 and FIG. 2 includes a first connector 1 having a plurality of rod-like male-type terminals 3 as a first terminal fitting, a male-type housing 4 as a first housing provided with a plurality of receiving portions 40 for receiving each of the plurality of male-type terminals 3, a plurality of contact-preventive portions 5 disposed between the male-type terminal 3 and the receiving portion 40 and having an aperture 5*a* through which the male-type terminal 3 is inserted and arranged to slide along a longitudinal direction of the male-type terminal 3 (i.e. an arrowed Y direction), and a plurality of shield members 8 mounted between the respective contact-preventive portions 5 and the respective receiving portions 40. The connector unit 20 further includes a second connector 2 having a plurality of female-type terminals 9 as a second terminal fitting arranged to connect to the respective male-type terminals 3, and a female-type housing 10 as a second housing (shown in FIGS. 6A, 6B) having a plurality of female-type receiving portions 11 for respectively receiving the plurality of female-type terminals 9 and arranged to moved towards the male-type housing 4 to be fitted with the male-type housing 4. In FIGS. 1 and 2, the second connector 2 is eliminated and not shown.

Furthermore, the connector unit 20 is arranged between an inverter and a motor which are electronic devices mounted on an automobile to electrically connect the inverter and the motor. By fitting the connectors 1 and 2 together, electric power from a battery is supplied to the motor via the inverter.

In FIG. 1 and other drawings, the arrowed Y direction indicates the longitudinal direction of the respective male-type terminals 3 as well as a direction in which the second connector 2 enters (i.e. moves towards) the first connector 1, an arrowed X direction indicates a direction of an alignment of the plurality of receiving portions 40 of the first connector 1, and an arrowed Z direction indicates a direction which intersects with both of the Y direction and the X direction.

The male-type terminal 3 described above is obtained by punching and bending a conductive sheet-metal. The respective male-type terminals 3 include a tab 30 formed into a rod-like shape and an attachment portion 31 formed at an end of the tab 30 so as to project in the X direction and arranged to attach the tab 30 for example to a device-side bus bar 13 connected to the inverter as the electronic device.

The male-type housing 4 described above includes the plurality of receiving portions 40 connected to each other and an attachment portion 41 arranged to attach the plurality of receiving portions 40 to a case portion of the inverter as the electronic device.

The plurality of receiving portions 40 are aligned along the X direction. Furthermore, as shown in FIGS. 2, 4A and 4B, the respective receiving portions 40 integrally includes a tubular-shaped first body portion 42, a tubular-shaped inner tube portion 43 arranged inside the first body portion 42 and arranged to position the respective tabs 30 inside to immovably-fix the respective tabs 30, and a second body portion 44 continuous with the first body portion 42, the second body portion 44 being arranged at the first body portion 42 and at the inner tube portion 43 located inside the first body portion 42 on a side close to the second connector 2 in the Y direction.

Figure 4A:
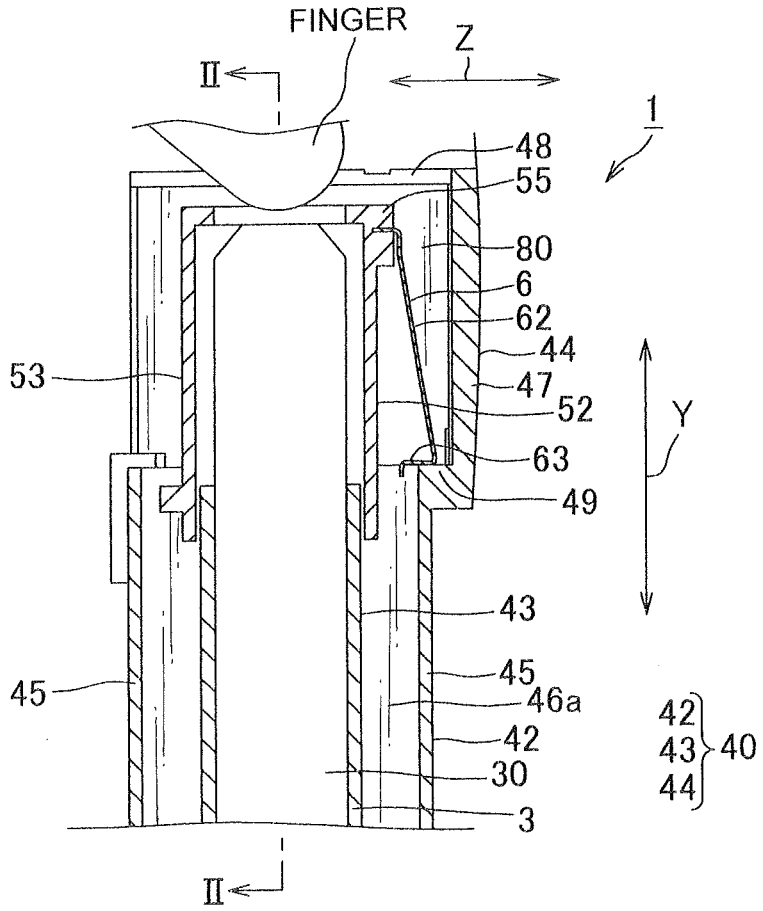
FIG. 4A is a cross-sectional view taken along a line I-I in FIG. 1.
Figure 4B:
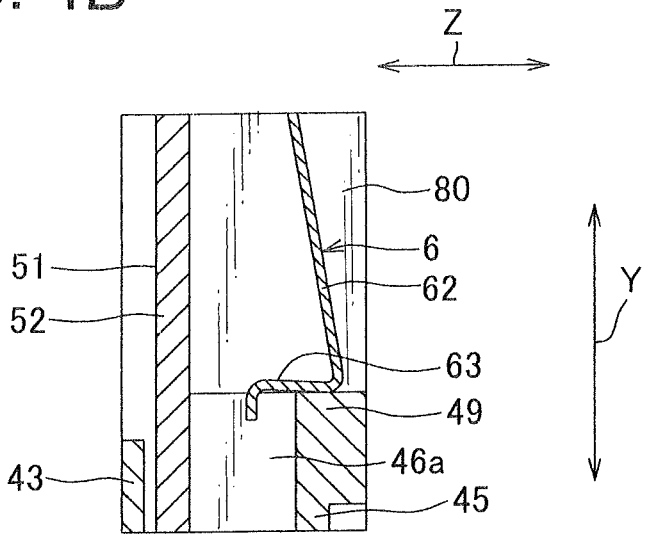
FIG. 4B is an enlarged view showing a main portion of FIG. 4A.

As shown in FIGS. 4A and 4B, a length of the first body portion 42 along the Y direction is formed longer than that of the inner tube portion 43, and (an end of) the first body portion 42 is arranged to project in the Y direction towards the second connector 2 more than the inner tube portion 43. In addition, as shown in FIG. 5, the first body portion 42 is positioned opposed to a case portion of the inverter and is formed into a tubular shape by a pair of opposed wall portions 45 opposed to each other and a pair of first side-wall portions 46 connecting the pair of opposed wall portions 45.

Figure 5:
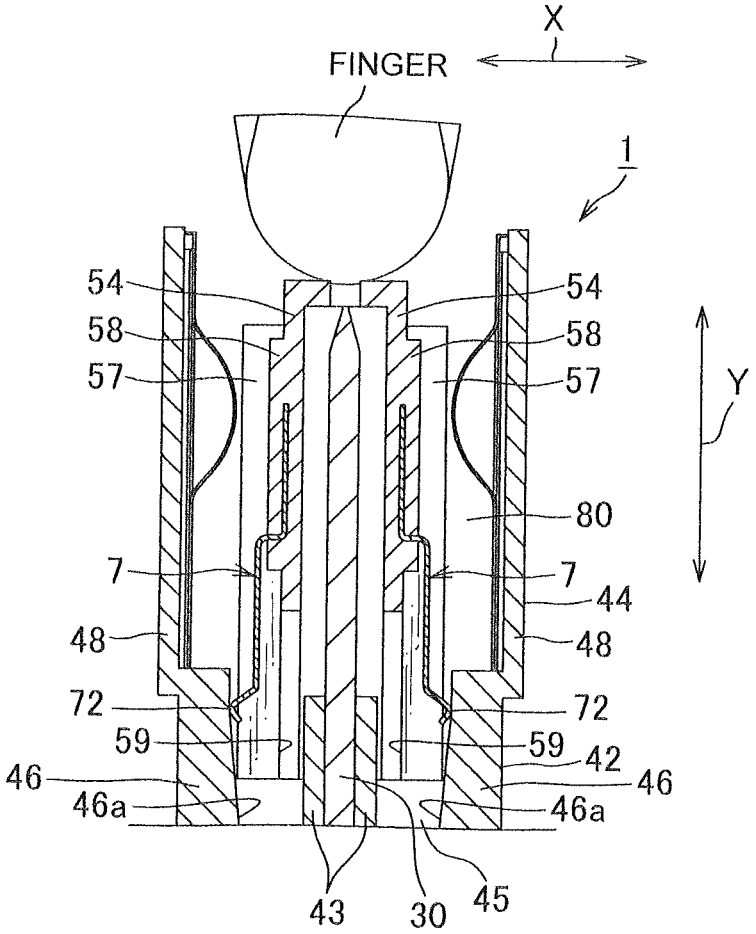
FIG. 5 is a cross-sectional view taken along a line II-II in FIG. 4.

As shown in FIG. 5, there is provided a slanted face 46*a* formed on an inner circumference of the first side-wall portion 46 and slanted so as to get closer to the male-type terminal 3 (i.e. slanted towards inside) as the distance from the second connector 2 in the Y direction.

The second body portion 44 is formed into a gutter shape by a top-wall portion 47 and a pair of second side-wall portions 48 continuous with top-wall portion 47, the top-wall portion 47 being continuous with one opposed wall portions 45 of the pair of opposed wall portions 45 distant from the inverter as the electronic device. The second side-wall portions 48 are respectively continuous with each of the pair of the first side-wall portions 46.

As shown in FIGS. 4A and 4B, the top-wall portion 47 is provide with an engagement receiving portion 49 arranged at an end of the top-wall portion 47 adjacent to the one opposed wall portion 45 (i.e. the first body portion 42) and arranged to project inwardly from the top-wall portion 47. The engagement receiving portion 49 is arranged to engage to or stop in an engaged-fashion at a later-described engagement portion 63 of a tension spring 6.

Figure 3:
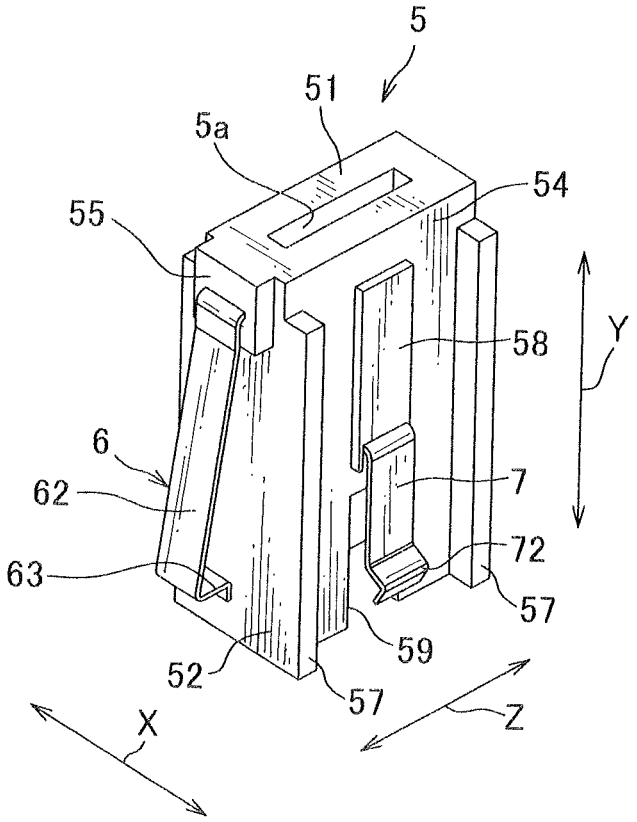
FIG. 3 is a perspective view showing a contact-preventive portion constituting the first connector unit shown in FIG. 2.

As shown in FIG. 3, the contact-protective portion 5 integrally includes a contact-preventive housing 51, the tension spring 6 and a pair of return springs 7.

The contact-preventive housing 51 is arranged to cover the respective male-type terminals 3 and is provide with the aperture 5*a* through which the tab 30 of the male-type terminal 3 is inserted. When the male-type terminal 3 is inserted into the aperture 5*a*, the contact-preventive housing 51 is allowed to slide along the longitudinal direction of the male-type terminal 3 (i.e. the Y direction). Furthermore, the contact-preventive housing 51 is arranged between the respective male-type terminal 3 and the male-type housing 4 (i.e. the receiving portion). As shown in FIGS. 3, 4A and 4B, the contact-preventive housing 51 is formed into a tubular shape by a top-plate portion 52 positioned at a location opposite of the top-wall portion 47, a bottom wall portion 53 opposed to the top-plate portion 52 and a pair of side-plate portions 54 positioned at a location opposed to the pair of second side-wall portions 48 of the male-type housing 4. The contact-preventive housing 51 is attached to the male-type housing 4 by a forward-detachment preventive means not shown.

As shown in FIG. 3, the top-plate portion 52 is provided with a first buried portion 55 projecting from an outer surface of the top-plate portion 52. This first buried portion 55 is arranged at an end of the top-plate portion 52 located on a side close to the second connector 2 in the Y direction, and one end of the tension spring 6 is buried at the first buried portion 55.

As shown in FIG. 3, each of the pair of side-plate portions 54 is provided with a pair of overhanging portions 57 and a second buried portion 55. Furthermore, there is provided a cutout portion 59 cut in a rectangular shape and formed at an end of the respective side-plate portions 54 on a side distant from the second connector 2 in the Y direction.

The pair of overhanging portions 57 is arranged at both ends of the side-plate portion 54 in the Z direction and extends along the side-plate portion 54 in the Y direction. Furthermore, the respective overhanging portions 57 are arranged to project from the outer surface of the top-plate portion 52.

The second buried portion 58 is formed between the pair of overhanging portions 57. Furthermore, the second buried portion 58 is arranged closer to the second connector 2 in the Y direction than the cutout portion 59 and aligned with the cutout portion 59. Furthermore, the second buried portion 58 is arranged to project from an outer surface of the respective side-plate portions 54. One end of the return spring 7 is buried at the second buried portion 58.

The tension spring 6 is obtained by punching and bending a conductive sheet-metal. Furthermore, as shown in FIGS. 3, 4A and 4B, one end of the tension spring 6 is buried at the first buried portion 55 and fixed at an outer circumference of the contact-preventive housing 51 and attached to the contact-preventive housing 51, while the other end of the tension spring 6 being a free end extending away from the second connector 2 in the longitudinal direction (i.e. the Y direction). The tension spring 6 includes a tapered portion 62 slanted away from the contact-preventive housing 51 in a direction from the one end to the other end of the tension spring 6, and the engagement portion 63 bent towards the contact-preventive portion 51 so as to project from an end of the tapered portion 62 (i.e. the above-described other end) towards the contact-preventive housing 51. Furthermore, there is provided a space between the engagement portion 63 and the contact-preventive housing 51 so as to allow the tension spring 6 to be elastically deformed in the Z direction.

The engagement portion 63 is arranged to engage to the engagement receiving portion 49 of the male-type housing 4 to restrict the contact-preventive housing 51 from sliding in the Y direction towards a basal portion (i.e. the attachment portion 31) of the male-type terminal 3. Herein, a term "the contact-prevention position" is defined as a position at which the contact-preventive housing 51 is positioned under a state in which the engagement portion 63 is engaged to the engagement receiving portion 49 of the male-type housing 4, i.e. a state in which the contact-preventive housing 51 is restricted from sliding.

The pair of the return spring 7 described above is obtained by punching and bending a conductive sheet-metal. Furthermore, as shown in FIGS. 3 and 5, one end of the return spring 7 is buried at the second buried portion 58 and fixed at an outer circumference of the contact-preventive housing 51 to be attached to the contact-preventive housing 51, while the other end of the return spring 7 being a free end extending away from the second connector 2 in the longitudinal direction (i.e. the Y direction). The other end of the return spring 7 is provided with an abutting portion 72 projecting towards the slanted face 46*a* (in an outward direction) so as to abut on the slanted face 46*a*. Furthermore, the return spring 7 is arranged to elastically deform in the X direction. Furthermore, the above-described cutout portion 59 of the contact-preventive housing 51 is arranged at an inner side of the abutting portion 72, so that when the abutting portion 72 is deformed inwardly, the abutting portion 72 is passed through the cutout portion 59.

The shield member 8 described above is made from a conductive sheet-metal and arranged to inhibit an electrical noise from leaking outside. Furthermore, the shield member 8 is disposed between the male-type housing 4 and the contact-preventive portion 5 and is attached to an inner side of the second body portion 44 of the male-type housing 4. Furthermore, the shield member 8 includes a body portion 80 formed into a gutter shape so as to cover the male-type terminal 3 and a plurality of claw portions 81 for the attachment to the second body portion 44 (i.e. the male-type housing 4).

The female-type receiving portion 11 described above includes an entering portion 12 arranged to project from the female-type receiving portion towards the first connector 1 and arranged to enter between the contact-preventive housing 51 and the male-type housing 4 (i.e. the first body portion 42). This entering portion 12 enters between the tension spring 6 and the male-type housing 4 (i.e. the receiving portion 40) and pushes the tapered portion 62 towards the contact-preventive housing 51, thereby disengaging the engagement portion 63 of the tension spring 6 from the male-type housing 4 (i.e. the receiving portion 40) to permit the contact-preventive housing 51 to slide.

In the following, an assembling procedure of the first connector 1 of the connector unit 20 is explained in reference with FIGS. 4A, 4B and 5. The male-type housing 4 is attached to the case portion of the inverter as the electronic device by inserting a bolt into the attachment portion 41 of the male-type housing 4. Then, the attachment portion 31 of the male-type terminal 3 passed through the inner tube portion 43 of the male-type housing 4 is placed onto the bus bar 13, and the male-type terminal 3 is attached to the device-side bus bar 13 using a bolt. Then, the top-plate portion 52 of the contact-preventive portion 5 and the top-wall portion 47 of the male-type housing 4 are positioned opposite to each other, and the tab 30 of the male-type tab 3 is inserted into the aperture 5*a* of the contact-preventive hosing 51, and the contact-preventive housing 51 is attached to the male-type housing 4 by the forward-detachment preventive means. As a result, the engagement portion 63 of the tension spring 6 is engaged to the engagement receiving portion 49. By doing so, the tension spring 6 serves to restrict the contact-preventive housing 51 from sliding away from the second connector 2 in the Y direction. At this time, as shown in FIG. 5, the abutting portion 72 of the return spring 7 is abutted on the slanted face 46*a*. Thus, the male-type terminal 3 is attached to the male-type housing 4. In such manner, the first connector 1 is assembled.

Figure 6A:
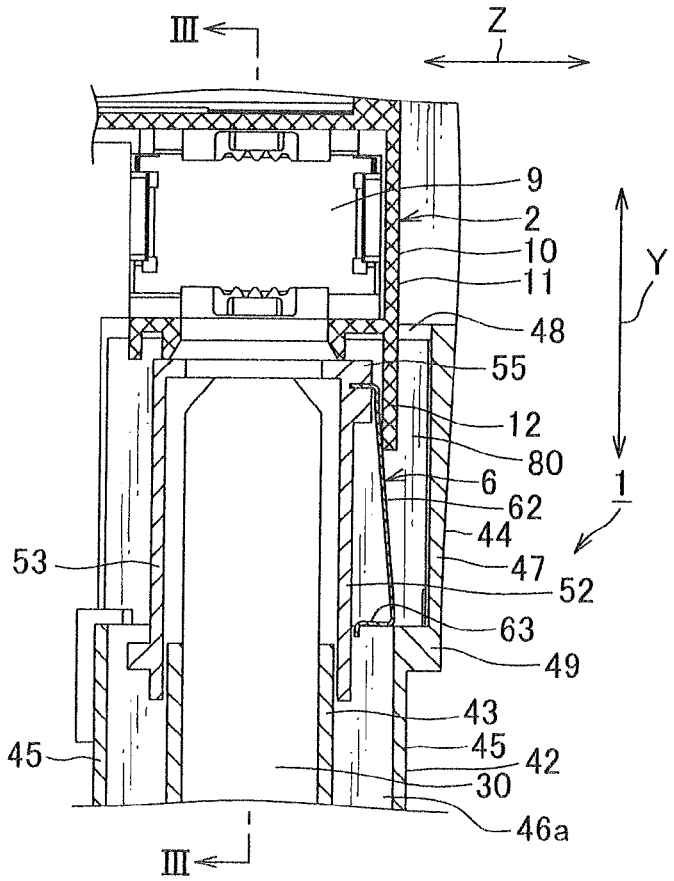
FIG. 6A is a cross-sectional view showing a state in which a second connector is moved towards the first connector of FIG. 1 and a tension spring is disengaged.
Figure 6B:
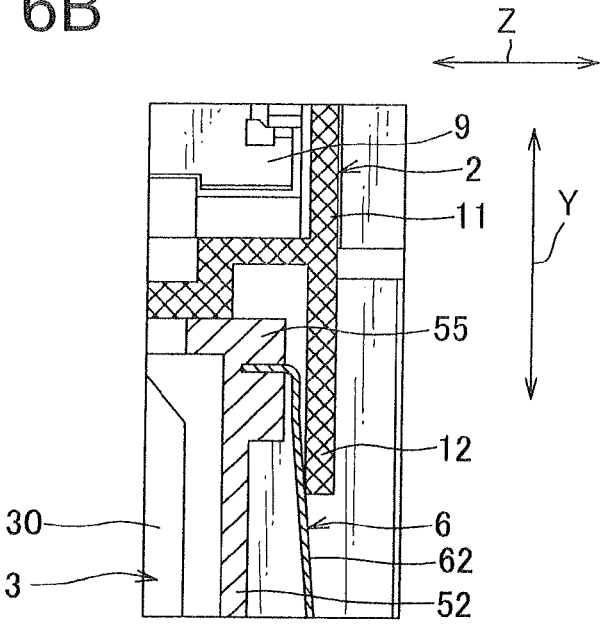
FIG. 6B is an enlarged view showing a main portion of FIG. 6A.
Figure 7:
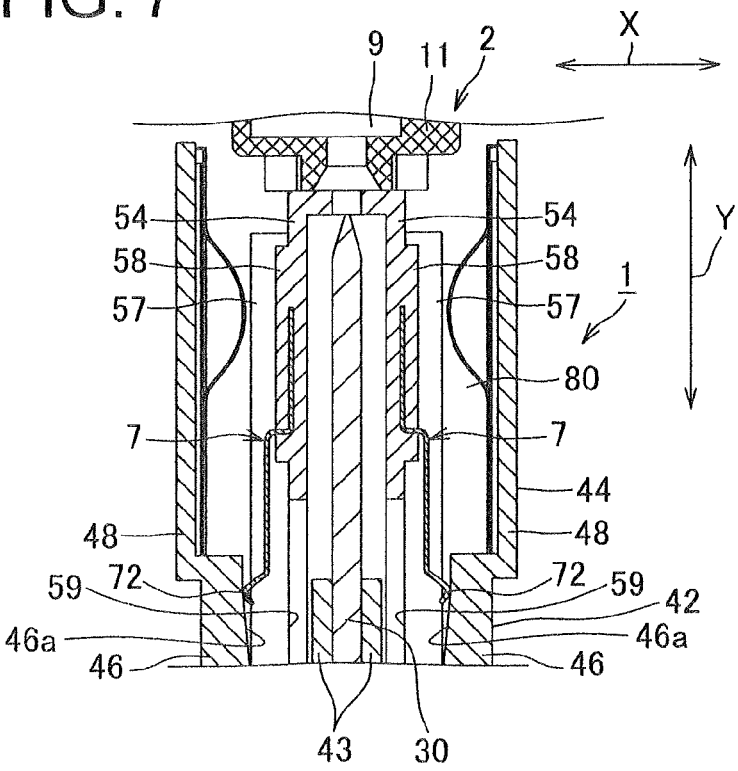
FIG. 7 is a cross-sectional view taken along a line in FIG. 6A.
Figure 8:
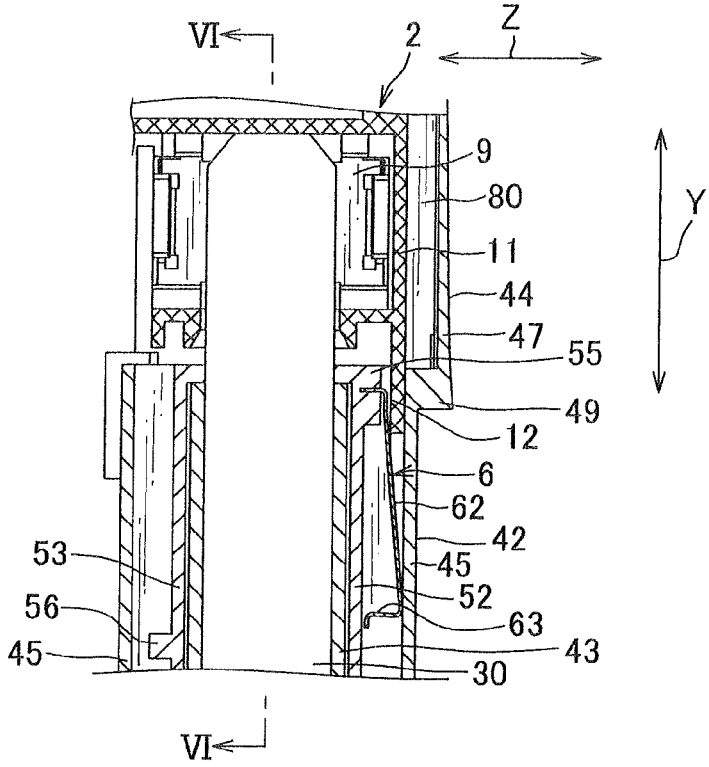
FIG. 8 is a cross-sectional view showing the second connector being moved towards the first connector with the tension spring being disengaged as in the state shown in FIGS. 6A and 6B.
Figure 9:
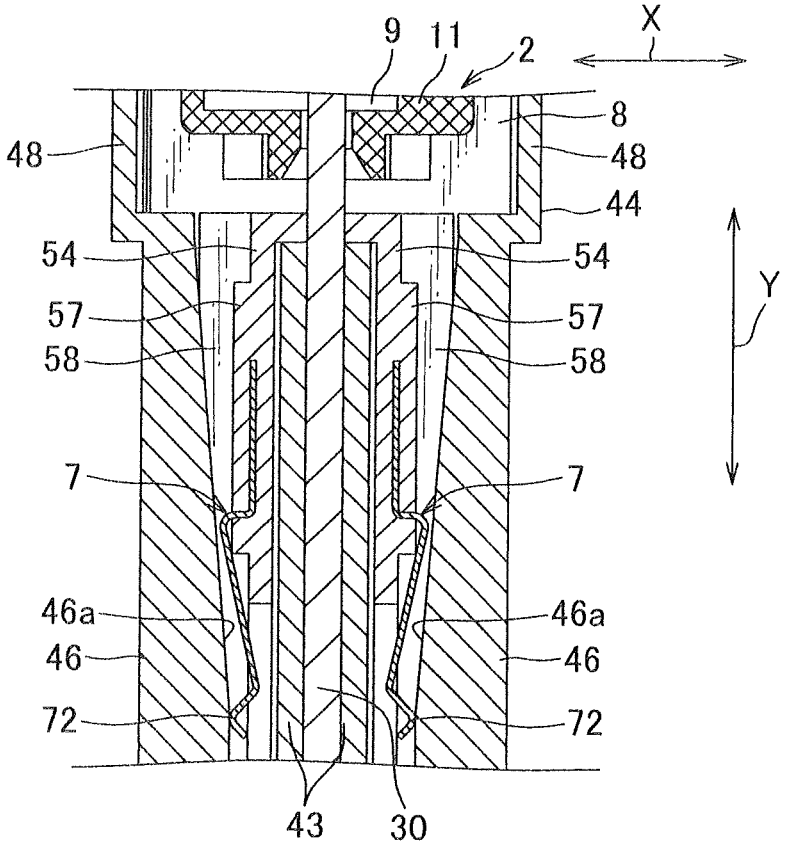
FIG. 9 is a cross-sectional view taken along a line IV-IV in FIG. 8.

Next, a fitting method for fitting together the first connector 1 and the second connector 2 is explained below in reference with FIGS. 6A, 6B, 7, 8 and 9. The first connector 1 assembled in a manner described above is moved towards the second connector 2. Then, the entering portion 12 of the second connector 2 enters between the tension spring 6 and the male-type housing 4 (i.e. the receiving portion 40). By further moving the second connector 2, the entering portion 12 abuts on the tapered portion 62 of the tension spring 6 and pushes the tapered portion 62 towards the contact-preventive housing 51. With the entering portion 12 pushing the contact-preventive housing 51, the engagement portion 63 is displaced towards inside of the receiving portion 40 (i.e. the male-type terminal 4) to a position at which the engagement portion 63 is not engaged to the engagement receiving portion 49. As a result, as shown in FIGS. 6A and 6B, the engagement portion 63 of the tension spring 6 is disengaged from the engagement receiving portion 49 of the male-type housing 4, thereby permitting the contact-preventive housing 51 to slide in a direction away from the second connector 2 along the Y direction.

Figure 11A:
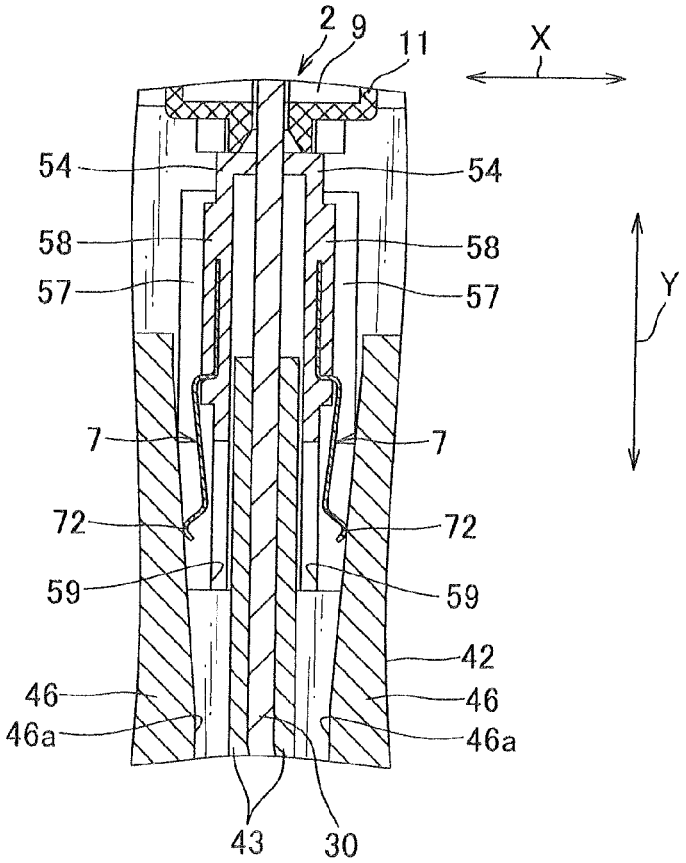
FIG. 11A is a cross-sectional view taken along a line V-V in FIG. 10.
Figure 11B:
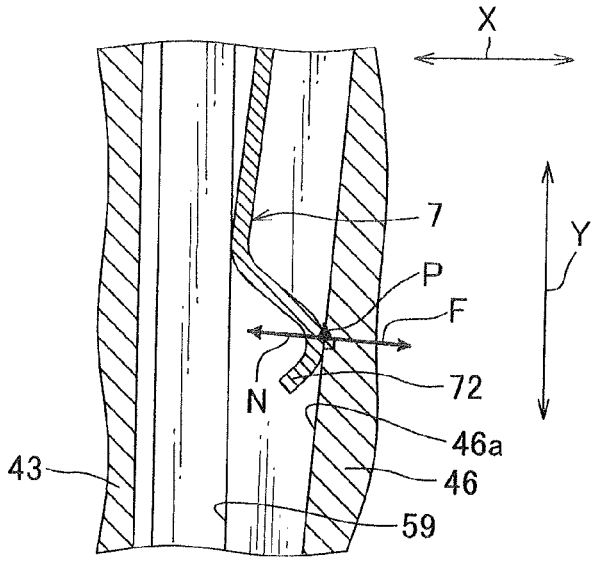
FIG. 11B is an enlarged view showing a main portion of FIG. 11A.
Figure 12:
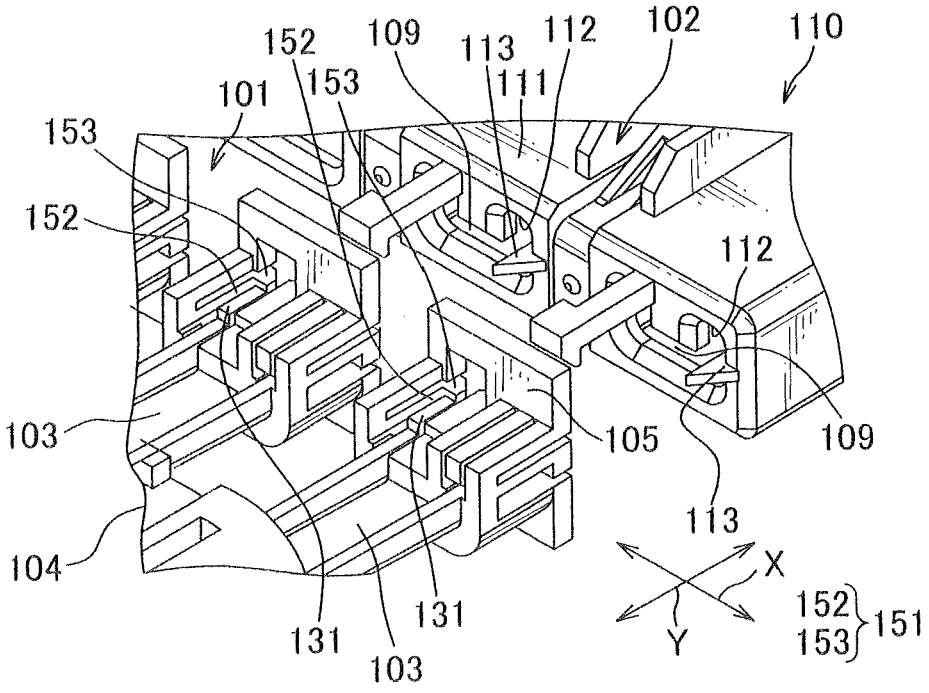
FIG. 12 PRIOR ART
FIG. 12 is a perspective view showing a conventional connector unit.

Furthermore, by moving the second connector 2 while the contact-preventive housing 51 is slidably movable in the direction away from the second connector 2 along the Y direction, the contact-preventive portion 5 is pushed by the second connector 2 in the direction away from the second connector 2 along the Y direction. Thus, as shown in FIG. 11, since the slanted face 46*a* is slanted towards the male-type terminal 3 in a direction away from the second connector 2 along the Y direction, a reaction force F of the return spring 7 is applied onto the slanted face 46*a*. Thus, the application of this reaction force F onto the slanted face 46*a* generates a perpendicular resistance force N which is reverse of the reaction force F and equal to the magnitude of the reaction force F. Thus, due to the generation of the perpendicular resistance force N, a force is applied in a direction of a resolved component P of the perpendicular resistance force N, thus, the abutting portion 72 (i.e. the return spring 7) exerts a force in the direction of the resolved component P, i.e. a direction towards the second connector 2 in the Y direction.

Furthermore, by moving the second connector 2, the contact-preventive portion 5 slides away from the second connector 2 along the Y direction, thereby exposing the male-type terminal 3. By further moving the second connector 2, the exposed male-type terminal 3 enters inside of the female-type terminal 9 of the second connector 2. As a result, these terminals 9 and 3 are connected to each other, and thus the connectors 1 and 2 are fitted together (shown in FIGS. 8 and 9). At this time, the return spring 7 is exerting a force towards the second connector 2 in the Y direction.

Figure 10:
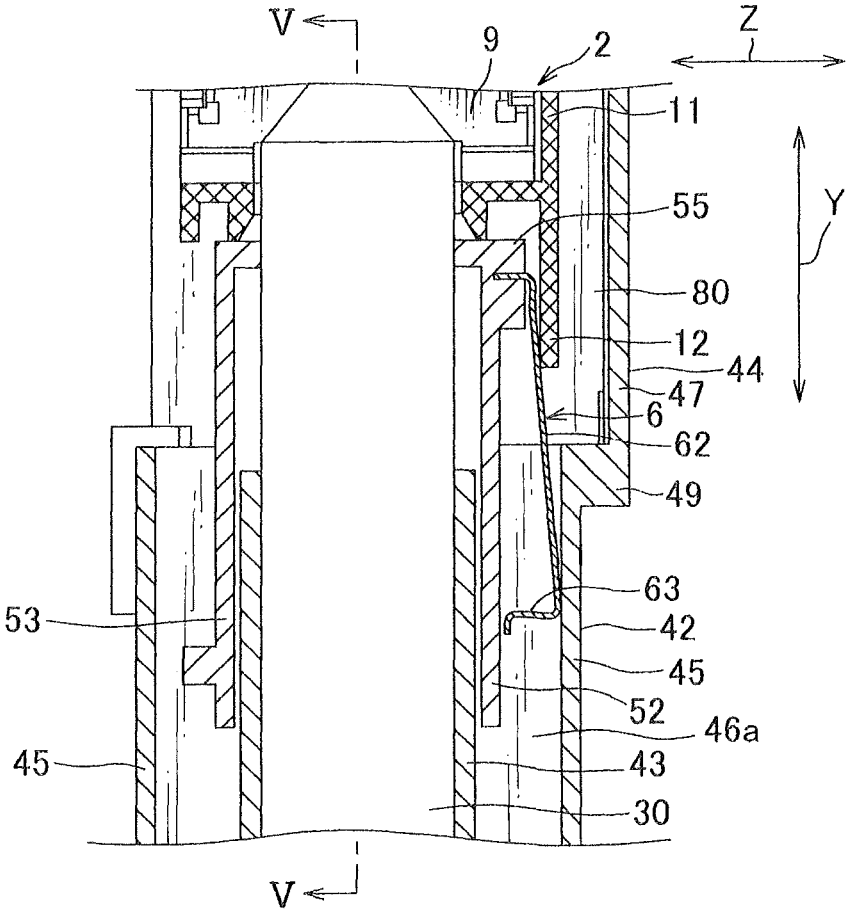
FIG. 10 is a cross-sectional view showing the second connector being separated away from the first connector with the tension spring being disengaged as in the state shown in FIG. 8.

Furthermore, as shown in FIGS. 10 and 11, before the connectors 1 and 2 are fitted together and while the contact-preventive housing 51 is slidably movable away from the second connector 2 in the Y direction (i.e. a half-fitted state), even when the second connector 2 is removed (separated) from the first connector 1, the return spring 7 exerts a force towards the second connector 2 in the Y direction and pushes back the contact-preventive housing 51 towards the second connector 2 in the Y direction. As a result, the engagement portion 63 of the tension spring 6 is engaged to the engagement receiving portion 49 of the male-type housing 4, so that the contact-preventive housing 51 is positioned at the contact-prevention position.

According to the embodiment described above, the connector unit 20 includes the first connector 1 and the second connector 2, the first connector 1 having the rod-shaped male-type terminal 3 as the first terminal fitting, the male-type housing 4 as the first housing formed into a tubular shape to receive the male-type terminal 3, and the contact-preventive housing 51 disposed between the male-type terminal 3 and the male-type housing 4, the contact-preventive housing 51 being formed into a tubular shape to pass the male-type terminal 3 therethrough and arranged to slide along the longitudinal direction of the male-type terminal 3 (i.e. the Y direction), the second connector 2 having the female-type terminal 9 as the second terminal fitting connected to the male-type terminal 3, and the female-type housing 10 arranged to receive the female-type terminal 9 and arranged to fit with the male-type housing 4. The contact-preventive housing 51 includes the tension spring 6 having the one end fixed at the outer circumference of the contact-preventive housing 5 and the other end being the free end extending away from the second connector 2 in the longitudinal direction (i.e. the Y direction) and arranged to engage to the male-type housing 4 to restrict the contact-preventive hosing 51 from sliding. The tension spring 6 is provided with the tapered portion 62 slanted away from the contact-preventive housing 51 in a direction from the one end towards the other end. The female-type housing 10 is provided with the entering portion 12 arranged to enter between the tension spring 6 and the male-type housing 4 as it is moved towards the male-type housing 4 and pushes the tapered portion 62 towards the contact-preventive housing 51, thereby disengaging the other end of the tension spring 6 from the male-type housing 4 to permit the contact-preventive housing 51 to slide. Consequently, while the other end of the tension spring 6 is engaged to the male-type housing 4, that is, while the contact-preventive housing 51 is positioned at the contact-prevention position, even if a user has pushed the contact-preventive housing 51 with a finger, the tension spring 6 restricts the contact-preventive housing 51 from sliding. Therefore, the male-type terminal 3 is prevented from being exposed, thereby providing the connector unit which can prevent the user from contacting the male-type terminal 3.

Furthermore, even if a user has pushed the contact-preventive housing 51 with a finger, the tension spring 6 will undergo a deformation, thereby pushing back a force applied to the contact-preventive housing 51. Consequently, there is no risk such as the breakage of the engagement arm 151 in the conventional case, and also the contact-preventive housing 51 can be positioned at the contact-prevention position in a reliable manner when fitting the first connector and the second connector 2 together.

Moreover, the entering portion 12 is arranged to enter between the tension spring 6 and the male-type housing 4 and pushes the tapered portion 62 towards the contact-preventive housing 51, thereby disengaging the tension spring 6 from the male-type housing 4 to permit the contact-preventive housing 51 to slide. Thus, the other end of the tension spring 6 engaged to the male-type housing 4 is displaced towards inside of the male-type housing 4, thereby disengaging the tension spring 6 from the male-type housing 4. Consequently, the tension spring 6 can be disengaged from the male-type housing 4 with a smaller force (i.e. more easily) compared to the conventional structure.

In addition, the tension spring 6 is made of metal. Thus, when heat is generated due to a current flow in the male-type terminal 3 and the tension spring 6 is exposed to the heat of the heated male-type terminal 3, there is less deterioration due to warpage or twist compared to the conventional engagement arm 151 made of resin, thereby allowing a long-term usage.

Furthermore, as described above, the return spring 7 is attached to the outer circumference of the contact-preventive housing 51, and the slanted face **46*a* is provided at the inner circumference of the male-type housing 4 and arranged to slant towards the male-type terminal 3 in a direction away from the second connector 2. Also, the return spring 7 is arranged to include the abutting portion 72 projecting towards the slanted face 46*a* so as to abut on the slanted face 46*a*. Thus, after the other end of the tension spring 6 is disengaged from the male-type housing 4, and when the second connector 2 is removed (separated) from the first connector 1 while the contact-preventive housing 51 being slidably movable, the reaction force of the return spring 7 pushes back the contact-preventive housing 51 towards the female-type housing 10 (i.e. the second connector 2) and the contact-preventive hosing 51 is positioned at the contact-prevention position. Consequently, the male-type terminal 3 is prevented from being exposed, thereby preventing the contact with the male-type terminal 3** in even more reliable manner.

Moreover, even without the use of a coil spring or the like as the return spring 7, the contact-preventive housing 51 can be pushed back towards the female-type housing 10 (i.e. the second connector 2) so the contact-preventive housing 51 is positioned at the contact-prevention position. Consequently, there is provided a simple structure and the manufacturing cost can be reduced.

In addition, according to the embodiment described above, the engagement portion 63 of the tension spring 6 is arranged to engage to the engagement receiving portion 49 of the male-type housing 4; however the present invention is not limited to this. That is, an end face of the male-type housing 4 which is arranged to engage to the engagement portion 63 may be used as the engagement portion 49.

In addition, according to the embodiment described above, the tension spring 6 is formed of metal; however the present invention is not limited to this, and the tension spring 6 may be formed of resin.

In addition, according to the embodiment described above, the return spring 7 is formed of metal; however the present invention is not limited to this, and the return spring 7 may be formed of resin.

The embodiments described above are only representative embodiments of the present invention, and the present invention is not limited to these embodiments. That is, the embodiments can be modified and performed in various ways without departing from the scope of the present invention.

REFERENCE SIGNS LIST

20 connector unit
1 first connector
2 second connector
3 male-type terminal (first terminal fitting)
4 male-type housing (first housing)
5*a* aperture
6 tension spring
7 return spring
9 female-type terminal (second terminal fitting)
10 female-type housing (second housing)
12 entering portion
49 engagement receiving portion
51 contact-preventive housing
62 tapered portion
63 engagement portion (the other end)
72 abutting portion

The invention claimed is:

1. An electrical connector unit comprising:

a first connector having a rod-shaped first terminal fitting with a longitudinal direction, a tube-shaped first housing having a receiving portion arranged to receive the first terminal fitting and a contact-preventive housing disposed between the first terminal fitting and the first housing, the contact-preventive housing including an aperture which the first terminal fitting is passed through, and being arranged to slide along the longitudinal direction of the first terminal fitting;

a second connector having a second female terminal fitting to be connected to the first terminal fitting and a second housing arranged to receive the second terminal fitting and arranged to fit with the first housing;

a return spring attached to the outer circumference of the contact-preventive housing; and a slanted face provided at an inner circumference of the first housing, the slanted face being slanted towards the first terminal fitting in a direction away from the second connector, wherein the contact-preventive housing includes a tension spring having one end fixed at an outer circumference of the contact-preventive housing and the other end arranged as an free end, the other end extending away from the second connector along the longitudinal direction and being arranged to engage to the first housing to restrict the contact-preventive housing from sliding, the tension spring including a tapered portion slanted away from the contact-preventive housing in a direction from the one end to the other end of the tension spring, wherein the second housing includes a forward entering portion configured to enter between the tension spring and the first housing when the second housing is moved relative to and towards the first housing such that the entering portion pushes the tapered portion towards the contact-preventive housing, thereby making the other end of the tension spring disengaged from the first housing to permit the contact-preventive housing to slide, and wherein the return spring includes an abutting portion arranged to project towards the slanted face so as to abut on the slanted face.

2. An electrical connector unit, comprising:

a first connector having a rod-shaped first terminal fitting with a longitudinal direction, a tube-shaped first housing having a receiving portion arranged to receive the first terminal fitting and a contact-preventive housing disposed between the first terminal fitting and the first housing, the contact-preventive housing including an aperture which the first terminal fitting is passed through, and being arranged to slide along the longitudinal direction of the first terminal fitting; and a second connector having a second female terminal fitting to be connected to the first terminal fitting and a second housing arranged to receive the second terminal fitting and arranged to fit with the first housing, a return spring attached to the outer circumference of the contact-preventive housing; and a slanted face provided at an inner circumference of the first housing, the slanted face being slanted towards the first terminal fitting in a direction away from the second connector, wherein the return spring includes an abutting portion arranged to project towards the slanted face so as to abut on the slanted face, wherein the contact-preventive housing includes a tension spring having one end fixed at an outer circumference of the contact-preventive housing and the other end arranged as an free end, the other end extending away from the second connector along the longitudinal direction and being arranged to engage to the first housing to restrict the contact-preventive housing from sliding, the tension spring including a tapered portion slanted away from the contact-preventive housing in a direction from the one end to the other end of the tension spring, wherein the second housing includes a forward entering portion configured to enter between the tension spring and the first housing when the second housing is moved relative to and towards the first housing such that the entering portion pushes the tapered portion towards the contact-preventive housing, thereby making the other end of the tension spring disengaged from the first housing to permit the contact-preventive housing to slide, and wherein the tension spring is made of metal.

* * * * *